United States Patent [19]

Jiruse et al.

[11] Patent Number: 4,488,484

[45] Date of Patent: Dec. 18, 1984

[54] CONTROL DEVICE FOR OFFSET PRINTING CYLINDERS HAVING ADJUSTABLY MOUNTED ECCENTRIC SHAFT

[75] Inventors: Jaroslav Jiruse, Blansko; Zbynek Liska, Adamov, both of Czechoslovakia

[73] Assignee: ZVS Adamovske strojirny koncernovy podnik, Adamov, Czechoslovakia

[21] Appl. No.: 499,809

[22] Filed: Jun. 1, 1983

[30] Foreign Application Priority Data

Jun. 1, 1982 [CS] Czechoslovakia ..... 4044-82

[51] Int. Cl.[3] ..... B41F 13/24

[52] U.S. Cl. ..... 101/248; 74/397

[58] Field of Search ..... 101/248, 174, 247, 349, 101/350–352; 74/397, 395

[56] References Cited

U.S. PATENT DOCUMENTS

| | | | |
|---|---|---|---|
| 3,610,064 | 10/1971 | Kaneko | 74/397 |
| 4,214,527 | 7/1980 | Kamoto | 101/248 |
| 4,336,755 | 6/1982 | Liska | 101/248 |

FOREIGN PATENT DOCUMENTS

| | | | |
|---|---|---|---|
| 137558 | 9/1979 | German Democratic Rep. | 101/248 |
| 2057970 | 4/1981 | United Kingdom | 101/248 |

*Primary Examiner*—E. H. Eickholt

[57] ABSTRACT

Control device for the offset cylinder of an offset printing machine, said control device selectively governing the movement of the offset cylinder into printing engagement with the plate and impression cylinders of the printing machine and the movement of the offset cylinder away from said plate and impression cylinders to relieve them of printing pressure. The control device mounts the offset cylinder sufficiently stiffly in the frame of the printing machine so as to avoid faults in the printing as, for example, the formation of strips on the printed paper sheets. The offset cylinder is rotatably mounted on an eccentric shaft which is mounted in first adjustable bearings which are arranged in eccentric bushings. On said eccentric bushings there are mounted second adjustable bearings which are arranged in bearing flanges which are adjustably fastened in the side walls of the printing machine.

11 Claims, 9 Drawing Figures

CONTROL DEVICE FOR OFFSET PRINTING CYLINDERS HAVING ADJUSTABLY MOUNTED ECCENTRIC SHAFT

This invention relates to a control device for printing cylinders, particularly for the cylinders on offset printing machines.

The control device for the printing cylinders on printing machines serves for the setting of the printing cylinders, for applying printing pressure thereto and for relieving them of such printing pressure. On offset printing machines the control of printing cylinders is carried out in such manner that the middle, offset or blanket cylinder is set or adjusted between its printing and non-printing positions with respect to both the first or plate cylinder and the third or impression cylinder.

The present invention has among its objects the provision of a control device for the printing cylinders of a printing machine in which the middle, offset cylinder is sufficiently rigidly mounted, and wherein, as a result, faults in the printing work, as for example the arising of strips (stripping) on the printed paper sheets is avoided.

A further aspect of the invention is to permit an easy and quick setting of the printing cylinders as to the printing pressure between them according to the thickness of the paper sheets to be printed, whereby the setting is carried out independently on both sides of the printing machine.

A known control device for printing cylinders has the shaft on the middle, offset or blanket cylinder mounted in bearings which are attached by means of adjustable supports on the side walls of the printing machine. The setting of the printing cylinders to establish the desired printing pressure between the cylinders, and the release of such printing pressure is carried out by hand.

A disadvantage of this known device is that the setting of the printing cylinders for printing pressure is not carried out in the printing interval, so that the first paper sheet is only partially printed, and often also a part of the third or impression cylinder becomes printed.

A further known control device for printing cylinders on modern printing machines is connected with the control mechanism of the printing machines in such manner that the setting of the printing cylinders for printing pressure is carried out within the cycle of the printing process.

A disadvantage of this device is the necessity of pressure lubrication of the eccentric bushings; a further disadvantage is the relatively great eccentricity of the bushings in their radial clearance.

In another known device the offset cylinder is mounted in cams which are supported at three points by means of bearings which are mounted to two adjustable pivots and on one spring-loaded pivot. The setting of the offset cylinder is carried out by turning the shaft and the cams which are mounted on the end pieces of the shaft. The rotary movement of the shaft is derived from the rotating mechanism of the printing machine by means of a lever mechanism and a double cam.

A disadvantage of this device is that the mounting of the offset cylinder is not sufficiently rigid because of the spring mounting of the cylinder shaft and the clearance provided in the supporting bearings.

A further known device is made in such manner that the offset cylinder is mounted in pivoted bearings which are provided with rings which, on each side wall of the printing machine, are rotatably mounted on two pressure rolls and on one guide roll. The offset cylinder is set for printing pressure or off-printing pressure by the turning of the rings of the bearings, which are provided with two flats on their circumferential surfaces. The turning of the bearing rings is derived by means of a lever and pull rod mechanism from the drive mechanism of the printing machine.

A disadvantage of this device is that the offset cylinder is inaccurately set as a result of the rolling of the surfaces of the bearing rollers between the pressure rollers and the guide roller. A further disadvantage is that the clearance in the pivotal bearings is not eliminated.

The above-described disadvantages of the prior art are avoided by the control device for printing cylinders according to the present invention.

In a first preferred embodiment of the invention, an offset cylinder is turnably mounted on an eccentric shaft which is mounted in first adjustable bearings. The adjustable bearings are arranged in eccentric bushings, on which there are mounted second adjustable bearings which are arranged in bearing flanges. The bearing flanges are fixed in the side walls of the printing machine, whereby on one end of the eccentric shaft there is attached a control lever which is connected by means of a pivot to a pull rod, which in turn is connected with a control mechanism of the printing machine. The eccentric bushings are provided with gear teeth which are in meshing engagement with gear segments, the gear segments in turn being mounted on a carrier shaft which is rotatably mounted in the side walls of the printing machine. On one bearing flange there is affixed a unit in which there is rotatably arranged a control worm which meshes with the gearing of the eccentric bushing.

In a second embodiment of the control device of the invention, hubs are provided on the toothed segment, in which hubs worms are rotatably mounted, such worms meshing with worm gears which are affixed to the carrier shaft, the toothed segments being rotatably mounted on a carrier shaft which is fixed in the side walls of the printing machine.

In a third embodiment of the device of the invention, in the side walls of the printing machine there are rotatably mounted regulators provided with a shaped profile by means of which they seat on the surface of bearing flanges. The regulators on one side are provided with a support and on the other side are provided with a screw on the shaft of which there is formed a worm gear which is in meshing engagement with a regulating worm, the worm being rotatably mounted in a holder which is attached on the side wall of the printing machine.

In a fourth embodiment of the invention, a control pull rod is attached by means of a pivot pin to a toothed segment. The control pull rod is also connected with a control mechanism of the printing machine. Regulators are arranged in the side walls of the printing machine on the other side of the first or plate cylinder, and of the third or impression cylinder. In an alternative execution of this embodiment, the regulators are arranged in the side walls of the printing machine on the adjacent side of the first or plate cylinder and the impression cylinder.

The places of support of the pivots of the eccentric shaft, of the eccentric bushings, of the bearing flanges, of the regulators, and of the supports are arranged at the same level or height in the side walls of the printing machine.

An advantage of the control device according to the invention is that the setting of the offset cylinder can be carried out accurately according to set values, so that the occurrence of strips on the printed sheets is avoided.

A further advantage of the device of the invention is that the supports, the eccentric bushings, the regulators, and bearings are arranged at the same height (in the same plane) in the inner side of the side walls of the printing machine, so that the printing pressure does not impose a tilting moment upon these parts of the printing machine.

A further advantage of the device of the invention is that after being set in the required position, the regulators and bearing flanges are secured in such required position by means of screws and nuts, so that a rigid system is provided without any possibility of deflection.

A further advantage of the device of the invention is that the regulators can be set very accurately by means of worms, and can be set on both sides of the printing machine independently one from the other.

A further advantage of the device of the invention is that it permits the regulation of the printing pressure of the printing cylinders according to the thickness of the paper sheets to be printed, such regulation being achieved from one operating place by means of an eccentric shaft, or by means of eccentric bushings.

The device according to the invention also provides the advantage that the clearance of the bearings can be eliminated by means of regulating nuts, which can be provided on a new printing machine as well as on a printing machine now in use.

The invention will be more fully understood upon consideration of the accompanying drawings, in which.

Figure 5:
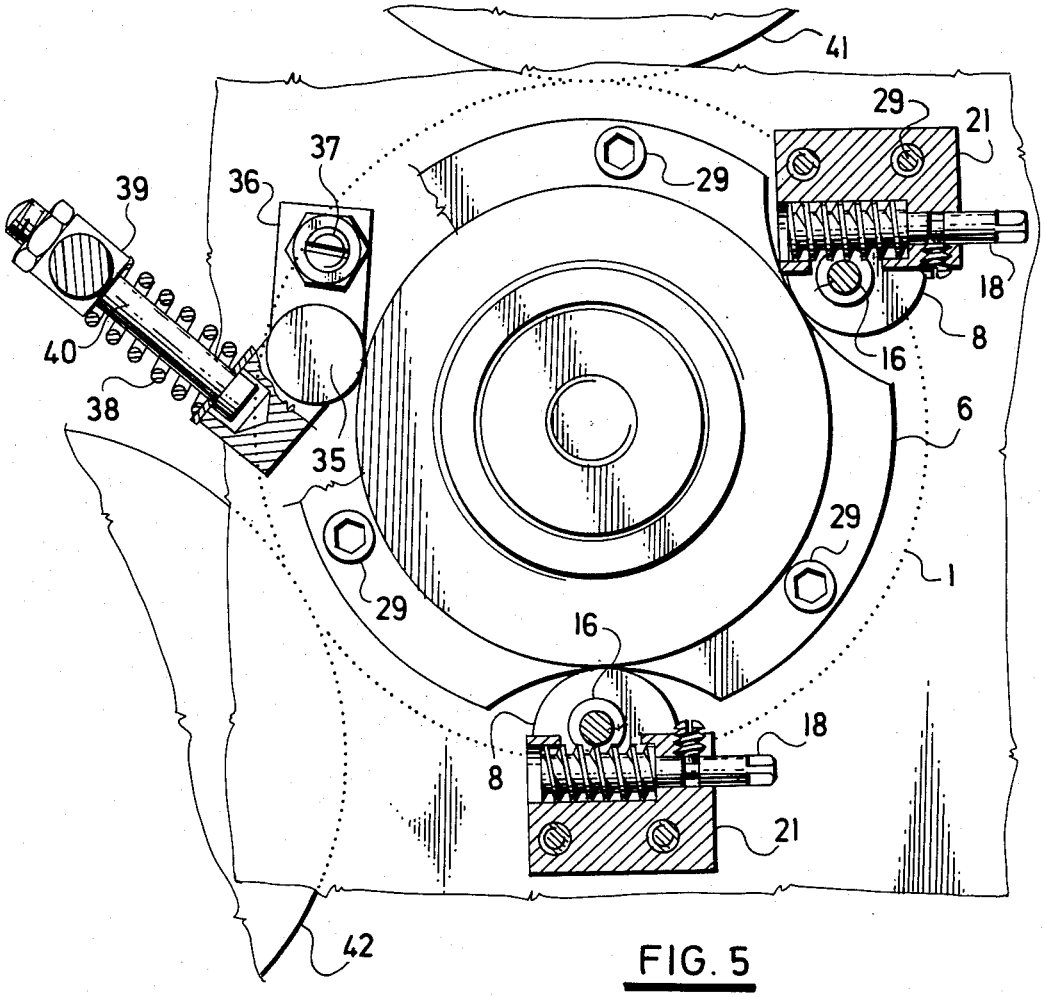
FIG. 5 is a view partially in transverse section and partially in end elevation of the device of FIG. 4 provided with regulators which are arranged on the opposite side of the first or plate cylinder, the section being taken along the line 5—5 in FIG. 4.
Figure 6:
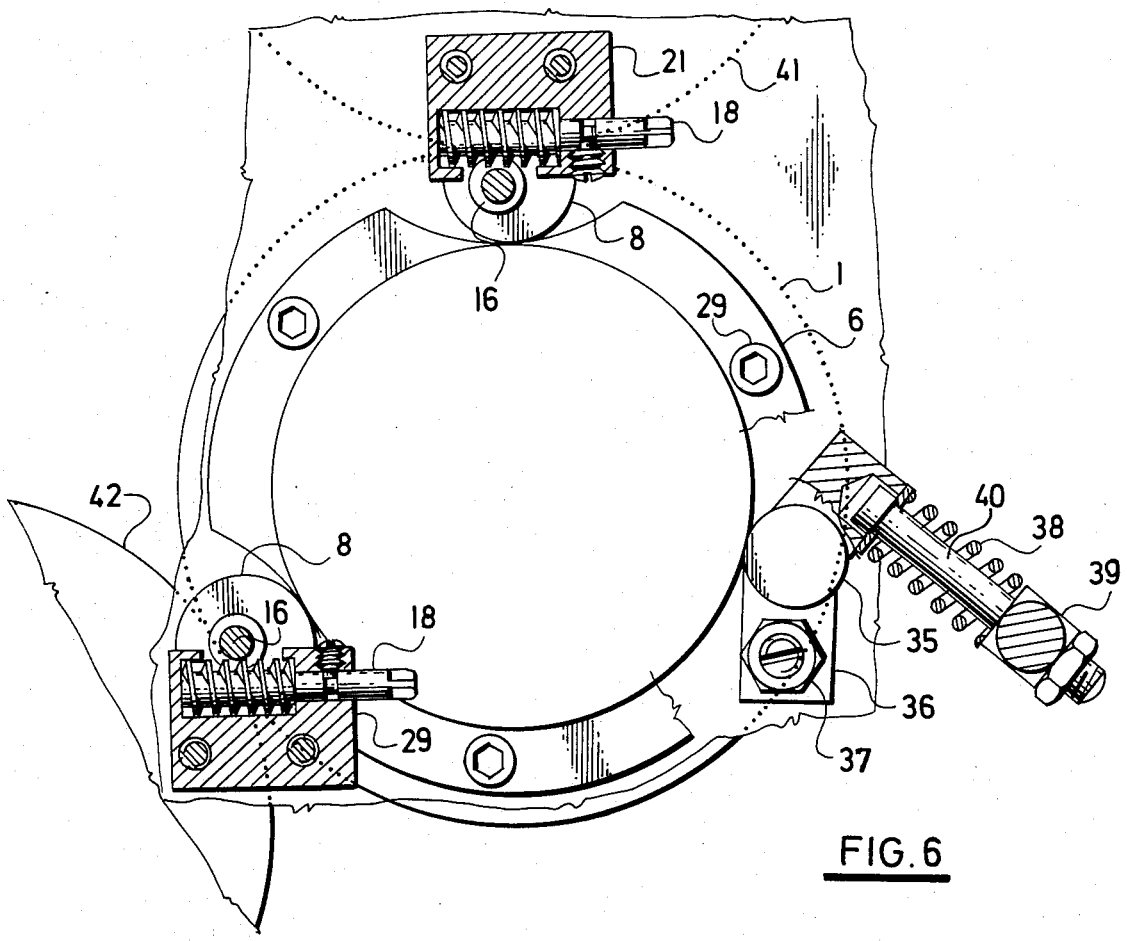
FIG. 6 is a view partially in transverse section and partially in end elevation of the control device with regulators which are arranged in side walls of printing machines on the adjacent side of the first or plate cylinder, the section being taken along the same section line as FIG. 5.

The control device of the present invention is illustrated herein when used with an offset printing machine such as schematically shown in FIGS. 5 and 6, wherein an offset cylinder 1 is arranged between a first or plate cylinder 41 and a third or impression cylinder 42. The plate cylinder 41 and the impression cylinder 42 are spaced apart a distance which is less than the diameter of offset cylinder 1.

Figure 1:
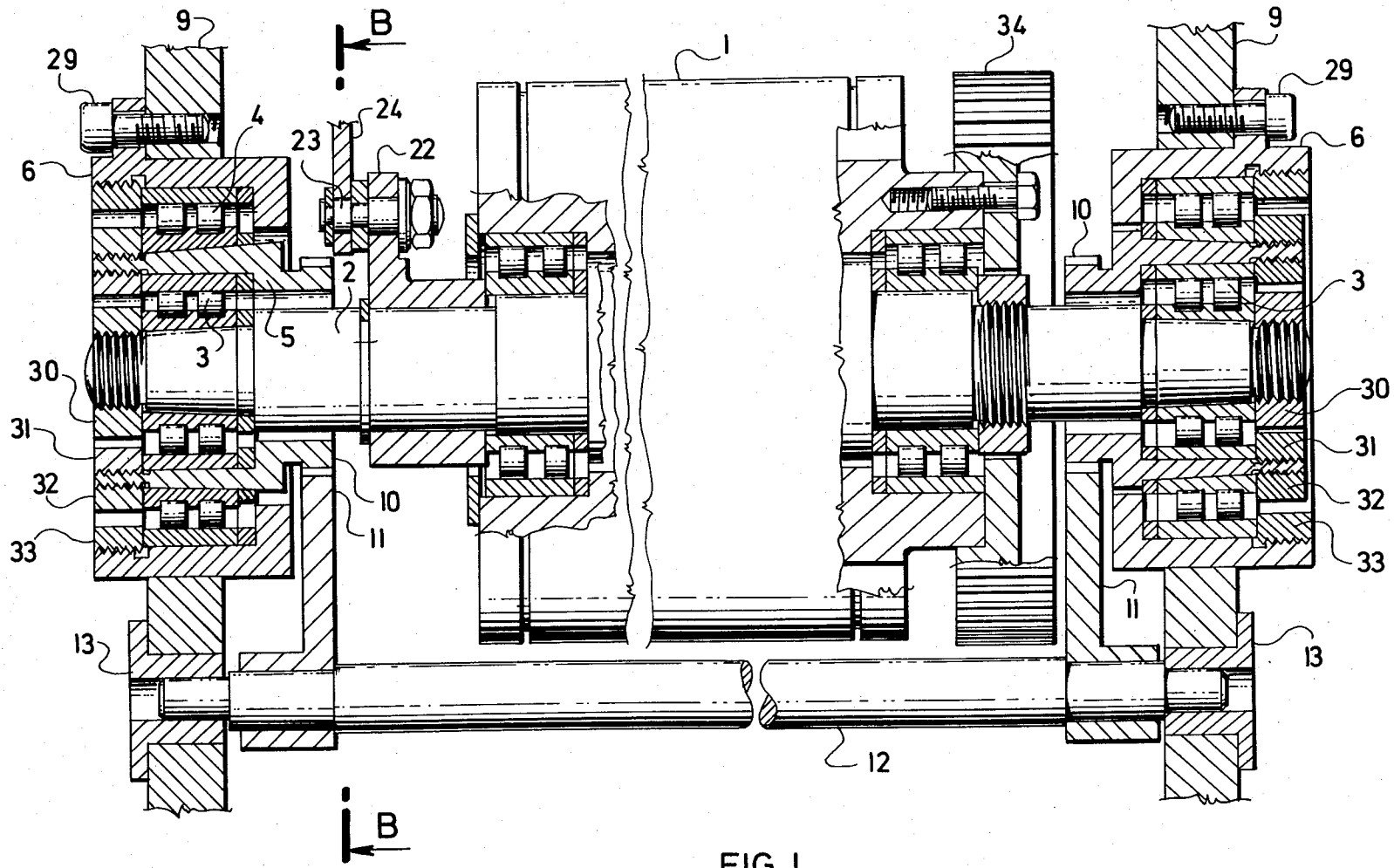
FIG. 1 is a view partially in longitudinal axial section through a first embodiment of control device in accordance with the invention and partially in side elevation.
Figure 2:
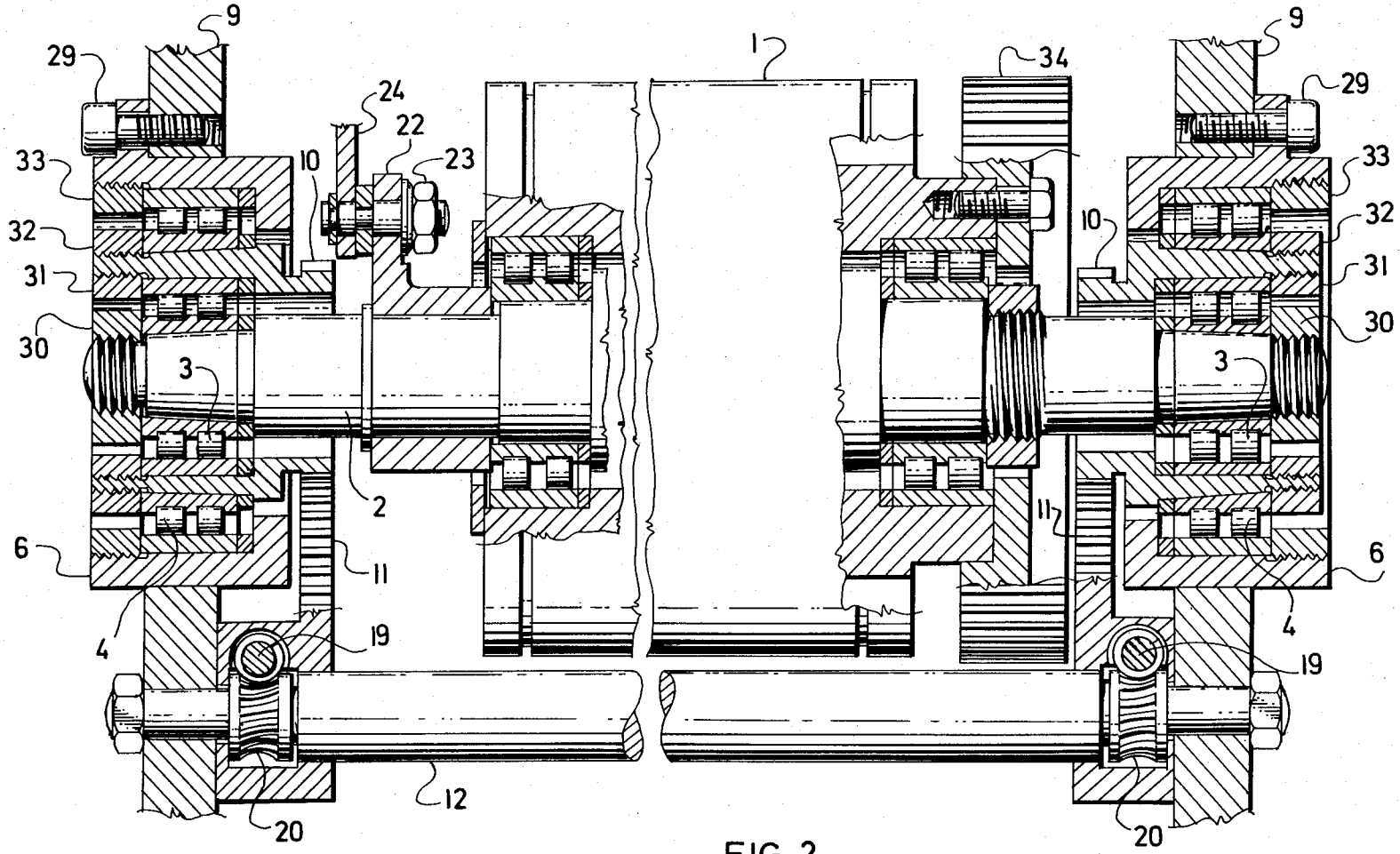
FIG. 2 is a view in in partial section through the device shown in FIG. 1, the section being taken along the line 2—2 in FIG. 1.

A first illustrative embodiment of control device in accordance with the invention is shown in FIGS. 1 and 2. In such embodiment a middle, offset cylinder 1 is rotatably mounted on an eccentric shaft 2 which is mounted in first adjustable bearings 3 arranged in eccentric bushings 5. On the eccentric bushings 5 there are mounted second adjustable bearings 4 which are arranged in bearing flanges 6; flanges 6 are shiftably attached to side walls 9 of the printing machine. The eccentric bushings 5 are provided with teeth 10 which are in meshing engagement with toothed segments 11. The toothed segments 11 are fixed on a carrier shaft 12 which is rotatably mounted in bushings 13 in the side walls 9 of the printing machine. On one of the bearing flanges 9 there is attached a unit 27 on which a control worm 28 is rotatably mounted; worm 28 is in engagement with the teeth 10 of the eccentric bushing 5, as more clearly shown in FIG. 2. On one end of the eccentric shaft 2 there is mounted a control lever 22 which is joined by means of a pin 23 with a pull rod 24; pull rod 24 is connected to a control mechanism (not shown) of the printing machine. On one side of the offset cylinder 1 there is attached a drive gear 34. The bearing flanges 6 are fixed in the side walls 9 of the printing machine by means of securing screws 29.

Figure 3:
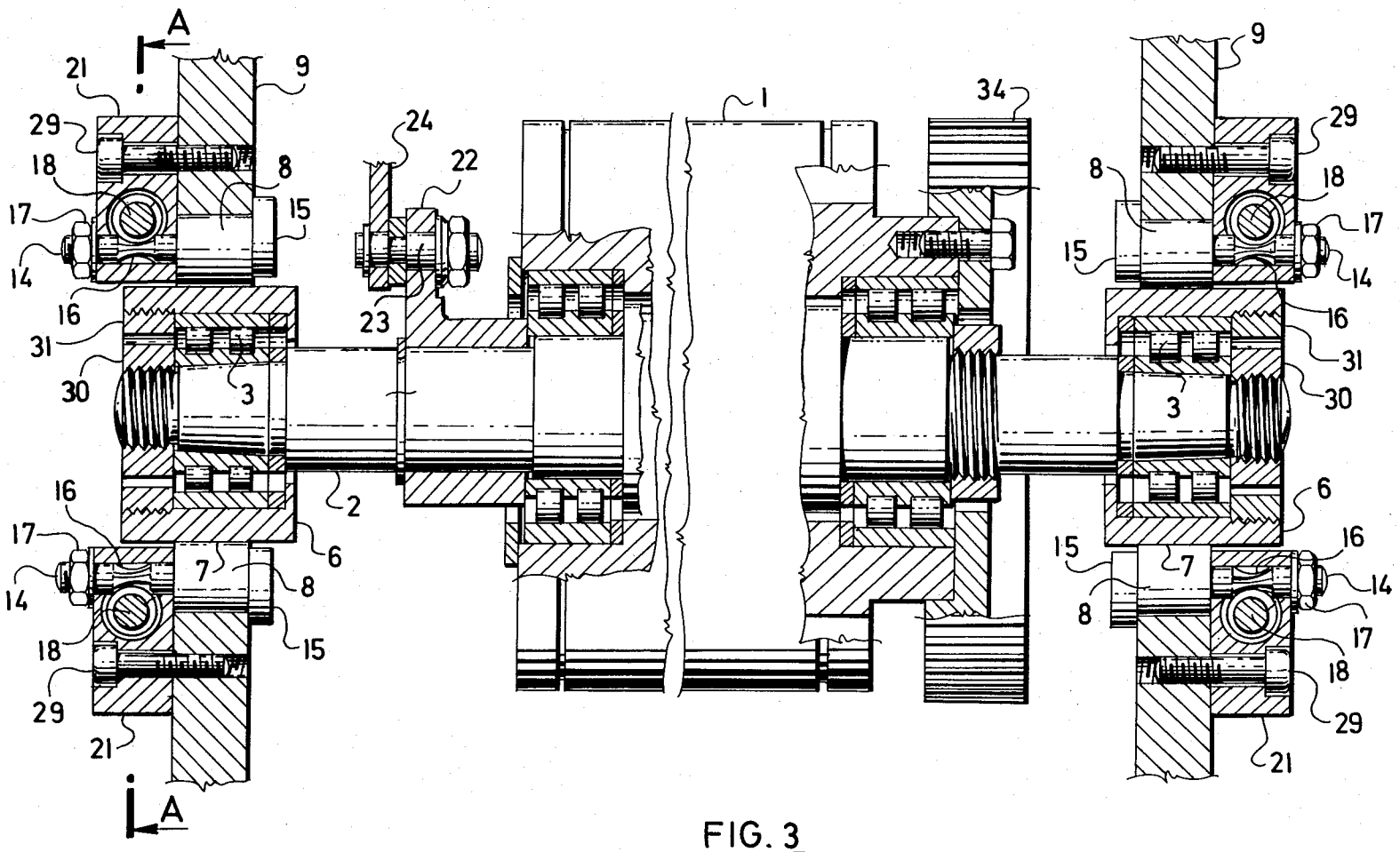
FIG. 3 is a sectional front view of a second embodiment of the control device of the invention, such device including toothed segments which are controlled by a worm drive.

In FIG. 3 there is shown a second embodiment of the control device of the invention. In this embodiment hubs are formed on the toothed segments 11, carrier worms 9 being rotatably arranged in such hubs. The carrier worms 19 mesh with gears 20 which are fixed on the carrier shaft 12; shaft 12 is mounted in the side walls 9 of the printing machine.

Figure 4:
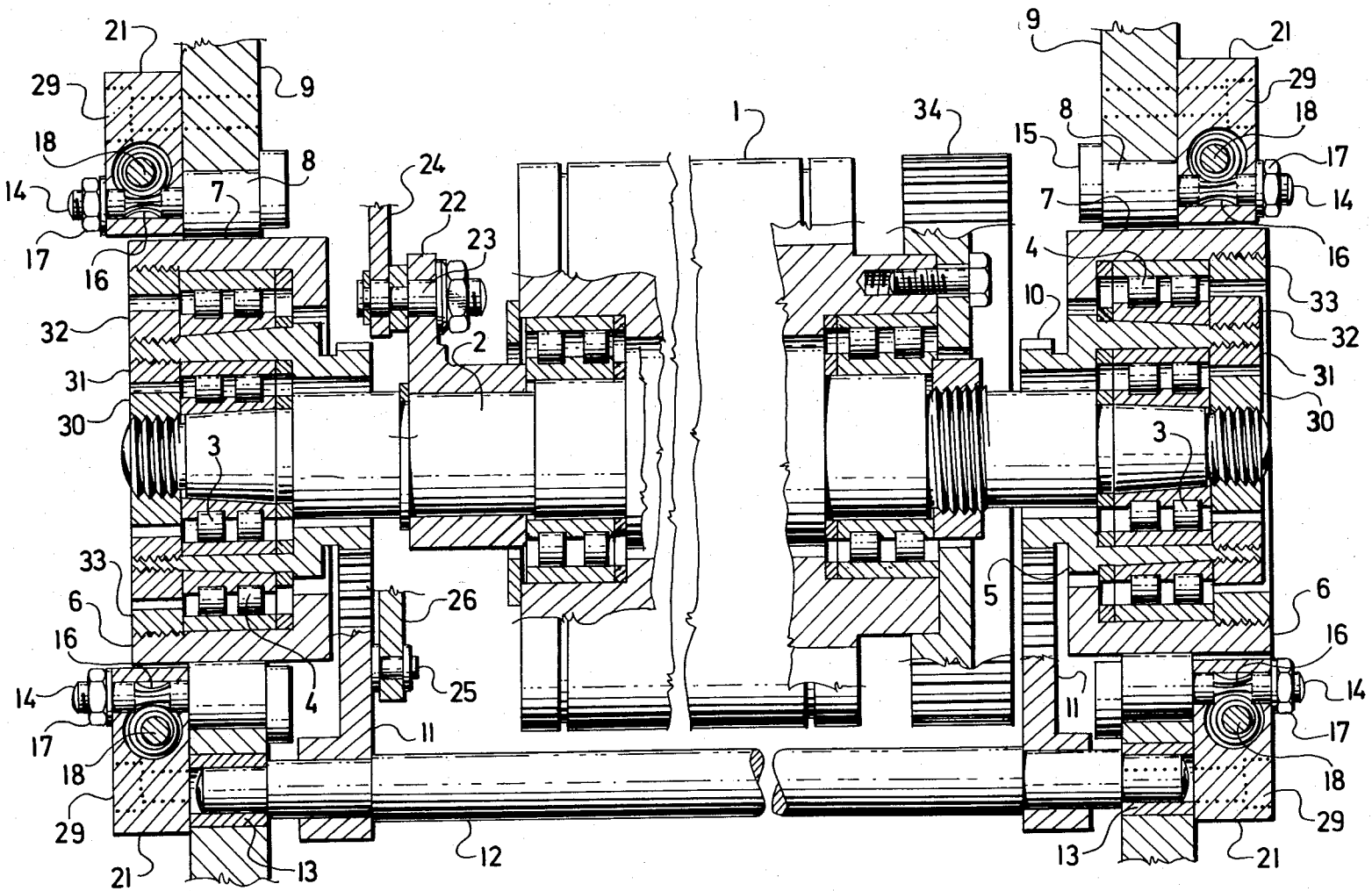
FIG. 4 is a front view in partial section of a third embodiment of the control device of the invention, such device being provided with regulators.

FIGS. 4 and 5 show a third embodiment of the control device of the invention. In the side walls 9 of the printing machine there are rotatably arranged regulators 8 which are provided with a shaped profile by means of which the regulators 8 seat on the surface of the bearing flanges 6. On one side the regulators 8 are provided with a support 15, and on the other side they are provided with a screw 14 which is provided with a nut 17. On the shank of the screw 14 there are formed worm gears 16 which are in meshing engagement with the regulating worms 18. The regulating worms 18 are rotatably arranged in holders 21 which are fixed to the side walls 9 of the printing machine.

As shown in FIG. 4, on the toothed segment 11 there is attached by means of a pivot pin 25 a control pull rod 26 which is connected with a control mechanism (not shown) of the printing machine. On the side opposite the reguators 8 there are arranged supports 35 which are attached on levers 36 which are mounted by means of pivot pins 37 in the side walls 9 of the printing machine. The thrust pressure of the supports 35 is effected by coil compression springs 38 which are attached on guide elements 40 which are screwed in holders 39. The springs 38 bear at one end on the levers 36 and at the other end on the holders 39. The regulators 8 are rotatably arranged in the side walls 9 of the printing machine on the side opposite to the first or plate cylinder 41 and to the third or impression cylinder 42 of the printing machine.

In an alternative embodiment of the device of FIGS. 4 and 5, shown in FIG. 6, the regulators 8 are rotatably arranged in the side walls 9 of the printing machine on the side adjacent the plate and impression cylinders.

Figure 7:
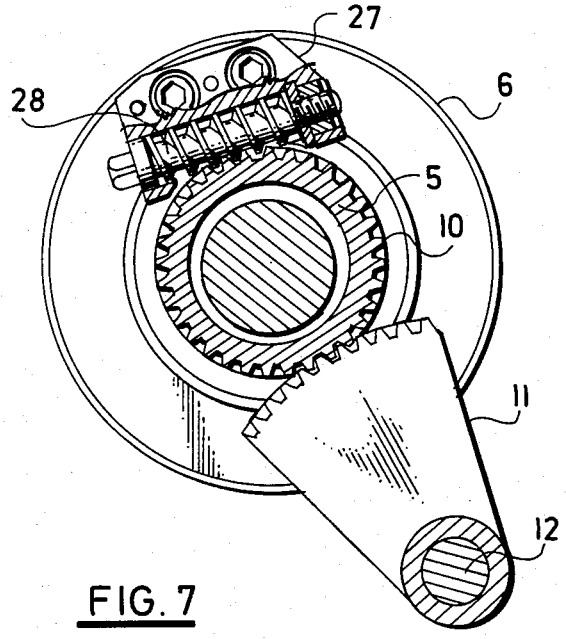
FIG. 7 is a view partially in section and partially in front elevation of a fourth main embodiment of the control device of the invention, such device being provided with a toothed segment which is controlled by a pull rod.

An alternative to the arrangement of FIG. 6 is shown in FIG. 7. In this embodiment the regulators 8 are rotatably arranged in the side walls 9 of the printing machine on the side which adjacent to the first or plate cylinder 41 and adjacent the third or impression cylinder 42. The supporting of the pivots of the eccentric shaft 2, of the adjustable bearings 3, 4, of the eccentric bushings 5, of the regulators 8 and of the supports 35 is provided at the same height (at the same level) in the side walls 9 of the printing machine. The regulators 8 are secured by means of nut 17 in the side walls 9 of the printing machine. The inner ring of the adjustable bearing 3 is secured by means of a first setting nut 30 which is screwed on the end part of the eccentric shaft 2. The outer ring of the first adjustable bearing 3 is secured by means of a second setting nut 31 which is screwed into the inwardly threaded part of the eccentric bushing 5. The inner ring of the second adjustable bearing 4 is secured by means of a third setting nut which is screwed on an outwardly threaded part of the eccentric bushing 5. The outer ring of the second adjustable bearing 4 is secured by means of a fourth setting but 33 which is screwed into an inwardly threaded part of the bearing flange.

Figure 9:
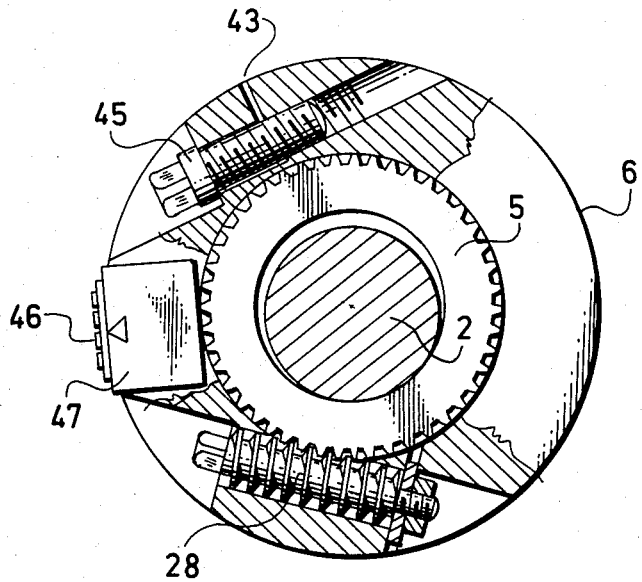
FIG. 9 is a view partially in transverse section and partially in end elevation of a part of the device shown in FIG. 8, the section being taken along the line 9—9 in FIG. 8.
Figure 8:
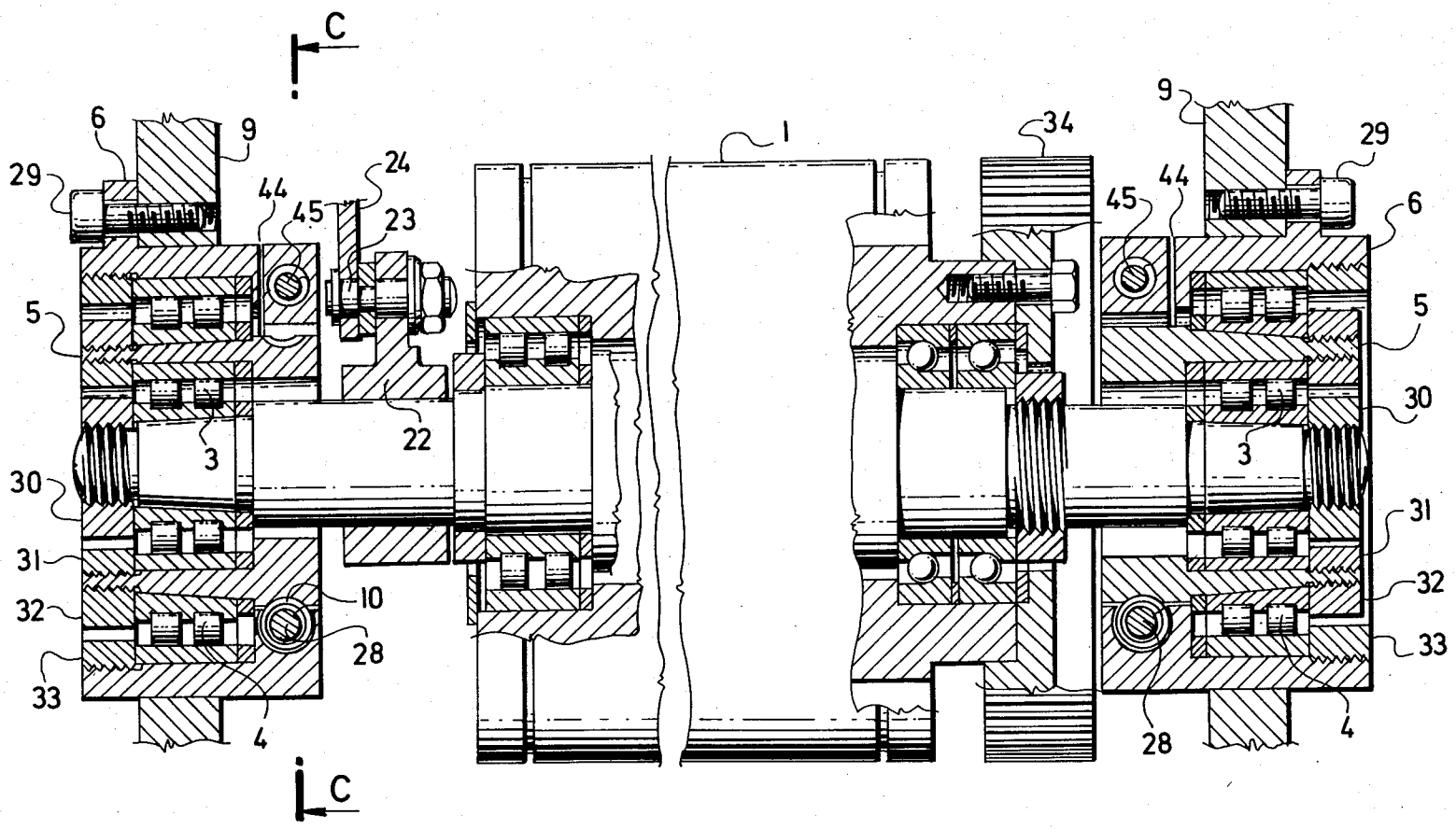
FIG. 8 is a view partially in longitudinal axial section and partially in side elevation of a fifth main embodiment of the device of the invention.

A fifth main embodiment of the control device of the invention is shown in FIGS. 8 and 9. Here control worms 28 are mounted in bearing flanges 6 which are provided with a longitudinal groove 43 and with a transverse groove 44. Both parts of the bearing flanges 6 which are separated or parted by the longitudinal groove 43 are held together by means of a securing screw 45. On the eccentric bushings 5 there are attached indicators 47; scales or graduations 44 are provided on the bearing flanges 6.

The control device of the invention operates as follows:

The regulation of the printing pressure on the printing cylinders is carried out by the turning of the eccentric bushings 5 by means of the control worm 28 (see FIGS. 1 and 2). The connection of the eccentric bushings 5 is achieved by the carrier shaft 12 and by means of the toothed segments 11.

With the embodiment of the control device shown in FIGS. 4 and 5 the printing pressure is set by turning the regulators 8 by means of regulating worms 18. In the embodiment of FIG. 3 the turning of the eccentric bushings 5 is carried out by means of carrier worms 19. The setting of the offset or middle cylinder 1 for printing pressure with respect to the plate or first cylinder 41 and with respect to the impression or last cylinder 42 is carried out by the turning of the regulators 8, the shaped profile 7 of which press on the bearing flanges 6. After this setting, the regulators 8 are secured in position by means of nut 17 on the screws 14, and by tightening the securing screws 29 and the bearing flanges 6 so that the whole device becomes a rigid unit. On the side opposite the regulators 8 there is arranged a sprung support 35 which provides a third supporting point for the mounting of the offset cylinder 1.

The setting of the printing cylinders or printing pressure and the setting off or relief of the printing pressure by means of the machine mechanism is derived from a mechanism (not shown) by means of a pull rod 24 which is joined to a control lever 22 by means of a pivot pin 23. The control lever 22 turns the eccentric shaft 2 and thus the offset cylinder is set for printing pressure with respect to the plate cylinder 41 and with respect to the impression cylinder 42, or the pressure exerted by the offset cylinder upon the plate cylinder and the impression cylinder is relieved.

With the embodiment of FIG. 7, by the turning of the eccentric shaft 2 the offset cylinder 1 is set (or released from) only one counter-cylinder. The setting of the offset cylinder 1 to the other, second counter-cylinder (or the release of pressure therebetween) is carried out by the turning of the eccentric bushings 5 by means of the toothed segments 11, the pivot 25 and the control pull rod 26 which is connected to a mechanism (not shown) of the machine.

The embodiment of FIGS. 8 and 9 of the control device of the invention operates as follows:

When the printing cylinders for printing is adjusted for printing pressure according to the thickness of the paper sheets to be printed, first the securing screws 45 are loosened. Then the eccentric bushings 5 are turned by turning of the control worms for the necessary value which is set by means of the indicator 47 on scale 46. When the setting for required printing pressure is carried out, the securing screws 45 are again tightened, whereupon the eccentric bushings 5 are clamped by the parted bearing flanges 6, so that a rigid unit is formed.

Although the invention is described and illustrated with reference to a plurality embodiments thereof, it is to be expressly understood that it is in no way limited to the disclosure of such preferred embodiments but is capable of numerous modifications within the scope of the appended claims.

We claim:

1. In an offset printing machine wherein the printing unit includes a plate cylinder, an offset cylinder, and an impression cylinder arranged in that order, the confronting surfaces of the plate cylinder and the impression cylinder being spaced a distance less than the diameter of the offset cylinder, and means for selectively moving the offset cylinder toward the plate and impression cylinders to exert printing pressure thereon and to move the offset cylinder away from the plate and impression cylinders to relieve them of printing pressure, the improved control device for the offset cylinder comprising means for rotatably mounting the offset cylinder on an eccentric shaft which is mounted in first adjustable bearings arranged on eccentric bushings, and second adjustable bearings mounted on said eccentric bushings, said second bearings being arranged in bearing flanges which are shiftably attached to side walls of the frame of the printing machine, said eccentric shaft being affixed to one end of a control lever, said control lever being joined by means of a pivot pin to a pull rod which is connected with the control mechanism of the printing machine.

2. A control device according to claim 1, wherein the eccentric bushings are provided with gear teeth which are in meshing engagement with gear segments, said gear segments being rigidly mounted on a carrier shaft which is rotatably mounted in the side walls of the printing machine.

3. A control device according to claim 2, wherein on one of the bearing flanges there is attached a unit in which there is rotatably mounted a control worm which meshes with the gear teeth on the eccentric bushing.

4. A control device according to claim 2, wherein hubs are provided on the segments, said hubs bearing gear teeth, carrier worms rotatably mounted on said hubs, said carrier worms being in mesh with worm gears which are rigidly mounted on said carrier shaft, said carrier shaft being mounted for rotation in the side walls of the printing machine and being held from motion other than motion of rotation.

5. A control device according to claim 1, wherein in the side walls of the printing machine there are rotatably arranged regulators which are provided with a shaped profile by means of which they engage the surface of the bearing flanges, the regulators on one side thereof being provided with a support and on the other side thereof being provided with a screw on the shank of which there is formed a worm gear which is in meshing engagement with a regulating worm which is rotatably arranged in a holder fixed to a side wall of the printing machine.

6. A control device according to claim 2, wherein on the segment bearing gear teeth there is mounted by means of a pivot a control pull rod which is connected with a control mechanism of the printing machine.

7. A control device according to claim 5, wherein the regulators are arranged in the side walls of the printing machine on the side thereof opposite to the plate cylinder and the impression cylinder.

8. A control device according to claim 5, wherein the regulators are arranged in the side walls of the printing machine on the side thereof adjacent to the plate cylinder and the impression cylinder.

9. A control device according to claim 7, wherein on the side opposite to the regulators there are seated on the bearing flanges supports which are attached to levers which are pivoted on pivots mounted in the side walls of the printing machine, and spring means opposing turning of the levers about said pivots.

10. A control device according to claim 9, wherein the end pieces of the pivots of the eccentric shaft, of the adjustable bearings, of the eccentric bushings, of the bearing flanges, of the regulators, and of the supports, are all located at the same level and on the inner sides of the side walls of the printing machine.

11. A control device according to claim 1, wherein the bearing flanges are provided with longitudinal grooves and with transverse grooves which are disposed at right angles to the longitudinal grooves, and comprising securing screws mounted in the bearing flanges and extending vertically with respect to the longitudinal grooves therein.

* * * * *